United States Patent [19]

Orr

[11] 4,202,386

[45] May 13, 1980

[54] OVERFILL PREVENTIVE FUNNEL

[76] Inventor: Brian A. Orr, 1780 Dean Park Rd., Sidney, British Columbia, Canada

[21] Appl. No.: 902,561

[22] Filed: May 3, 1978

[30] Foreign Application Priority Data

Apr. 4, 1978 [CA] Canada ..... 300401

[51] Int. Cl.[2] ..... B65B 39/04

[52] U.S. Cl. ..... 141/300; 141/95

[58] Field of Search ..... 141/94, 95, 98, 199–205, 141/115, 297–300, 331–345, 392

[56] References Cited

U.S. PATENT DOCUMENTS

| | | | |
|---|---|---|---|
| 140,350 | 7/1873 | Crowther | 141/299 |
| 585,172 | 6/1897 | Ashbaugh et al. | 141/340 |
| 1,733,261 | 10/1929 | Higby et al. | 141/340 X |
| 2,831,452 | 4/1958 | Haynes | 141/300 X |

FOREIGN PATENT DOCUMENTS 1058171 11/1957 France .

*Primary Examiner*—Frederick R. Schmidt

[57] ABSTRACT

A funnel for use in filling containers with liquid and designed to prevent overflowing of the container during filling. The funnel has two air vents one of which is adapted to be closed during initial filling of the container while the other stays open to vent the container during this initial filling. When the container is nearly full, the liquid in it closes the second vent and this provides an indication in the funnel that filling is nearly completed. The first vent is then opened to allow filling of the container to be completed with a small amount of liquid remaining in, or added to, the funnel.

6 Claims, 5 Drawing Figures

OVERFILL PREVENTIVE FUNNEL

This invention is directed toward an improved funnel.

The invention is more particularly directed toward an improved funnel of the type designed to protect against overfilling a container and thus avoid spills.

A common problem when filling a first container with liquid from a second container using a funnel is the difficulty to know when the first container is almost filled so as to stop pouring liquid into the funnel from the second container to avoid spilling.

To overcome this problem it has been proposed to provide a funnel having an air vent to direct air being displaced from within the container being filled into the bowl of the funnel. This displaced air forms air bubbles within the liquid in the bowl. When the liquid within the container being filled rises to a point where the air inlet to the vent is closed, the air bubbles cease to appear in the liquid in the bowl thus indicating that the container is nearly filled and that pouring should stop. Such a funnel is shown in U.S. Pat. No. 3,973,602, by way of example.

Funnels of the above type have disadvantages however. The turbulence created by pouring the liquid from the second container into the funnel may hide the bubbles thus making it difficult to know when to stop pouring. Also, liquid remaining in the funnel, after pouring has stopped, can only be drained into the first container after the funnel has been dislodged from the container. This can result in spilling the remaining liquid in the container.

It is one purpose of the present invention to provide an improved funnel for protecting against overfilling of containers which funnel is easy to use and which minimizes the possibility of spilling any liquid.

It is another purpose of the present invention to provide an improved funnel of the above type which is simple to construct and to use.

A principal object of the invention is to provide a funnel having: a larger, liquid inlet at one top end and a small, liquid outlet at the other bottom end; means on the funnel between its two ends, for making a substantially air-tight connection with the inlet of a container to be filled; first and second separate vent means by-passing the connection means; each vent means having a first opening below the connection means and a second opening above the connection means, the first opening of the first vent means being located nearer to the other bottom end than the first opening of the second vent means.

The funnel of the present invention employs two air passage means or vents to aid in filling a container. The first vent is adapted to be closed during initial filling of the container while the second vent is open to exhaust air from the container as it is being filled. When the container is nearly full, resulting in closure of the second vent, an air lock is formed and liquid fills up the funnel. When the funnel is nearly full of liquid, pouring is stopped. The first vent is then opened, breaking the air lock in the container and allowing the remaining liquid in the funnel to substantially complete filling of the container. The empty funnel can then be removed without any danger of spilling liquid.

The invention is particularly directed toward a funnel having a large liquid inlet at one top end and a small, liquid outlet at the other bottom end with means on the funnel, between its two ends for making a substantially air-tight connection with the inlet of a container to be filled with liquid. The funnel has first and second separate vent means by-passing the connection means with each vent means having a first opening below the connection means and a second opening above the connection means. The first opening of the first vent means is located nearer to the other bottom end than the first opening of the second vent means.

The invention will now be described in detail having reference to the accompanying drawings in which.

Figure 1:
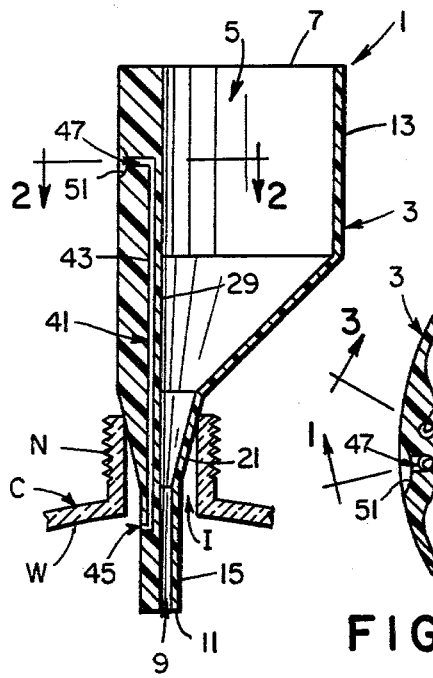
FIG. 1 is a vertical cross-section view of the funnel taken along line 1—1 of FIG. 2.
Figure 2:
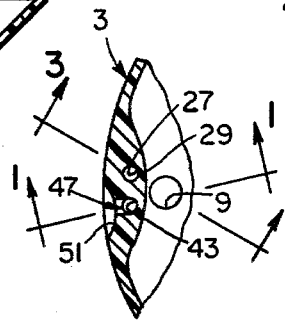
FIG. 2 is a cross-section view taken along line 2—2 of FIG. 1.
Figure 3:
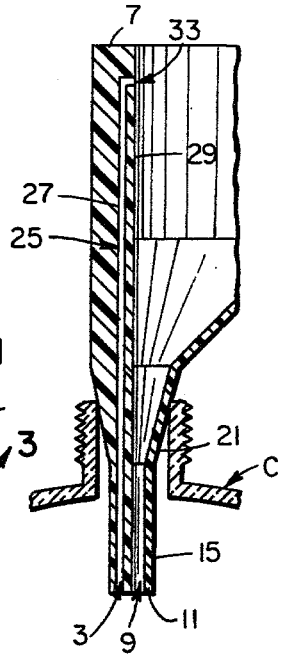
FIG. 3 is a cross-section view taken along line 3—3 of FIG. 2.

The funnel 1 of the present invention, shown in FIGS. 1 to 3, has a tubular wall 3 shaped to provide a large fluid inlet 5 at one top end 7 and a small fluid outlet 9 at its other bottom end 11. Preferably, as shown in FIG. 1, the wall 3 of the funnel is shaped to provide a large fluid receiving bowl 13, with its large open top forming the fluid inlet 5 of the funnel, and an outlet spout 15 projecting from one side of the bottom end of the bowl, with the small opening in the outlet end of the spout forming the small funnel outlet 9.

In accordance with the present invention, means are provided on the funnel 1 between its two ends 7, 11 to provide a substantially air-tight connection between the funnel and the neck "N" of the inlet "I" of the container "C" being filled with liquid. As shown in FIG. 1, these connecting means can comprise a collar 21 on the funnel, preferably positioned on the spout 15 adjacent its connection to the bowl 13. The collar 21 is tapered so as to increase in diameter from its smallest end, closest to the spout end 11, to its largest end, farthest from spout end 11. The tapered collar 21 is sized to frictionally fit tightly within the neck "N" of the container being filled so as to provide the substantially air-tight connection between the funnel and the container. The collar 21 can comprise a separate resilient member fastened to the funnel or it can be molded integrally with the funnel when the funnel is made from resilient material.

A first air passage or vent means 25 is provided on the funnel. This first vent means 25 can comprise a first passageway 27 moulded or otherwise formed in an enlarged portion 29 of the wall 3 of the funnel. The first passageway 27 has a first inlet opening 31 located on spout 15 near spout end 11. The inlet 31 preferably is right at the end 11 of the spout. A second outlet opening 33 for first passageway 27 is located between the funnel inlet end 7 and collar 21. Preferably, the outlet 33 is in the inner surface of bowl 13 adjacent its top, inlet end 7.

A second air passage or vent means 41 is provided on the funnel as shown in FIGS. 1 and 2. This second vent means preferably comprises a second passageway 43 moulded or otherwise formed in the enlarged wall portion 29. The second passageway 43 has a first inlet opening 45 located between the inlet 31 of the first passageway 27 and the collar 21. This inlet 45 is located on the outer wall surface of the spout 15, close to the collar 31.

The inlet 45 can be positioned to lie substantially even with the top wall "W" of the container "C" when the funnel 1 is in place. The second passageway 43 also has a second outlet opening 47 positioned between the collar 21 and the top, inlet end 7 of the funnel 1. The outlet 47 is preferably provided in the outer wall surface of the bowl 13 slightly below outlet 33 of the first passagway 27. If desired, a rounded indentation 51 can be provided in the outer wall surface of bowl 13 surrounding outlet 47.

In use, the funnel 1 is fitted to the container "C" to be filled with liquid, by passing its spout 15 down into the inlet "I" and tightly jamming the collar 21 against the inner surface of the neck "N" defining the inlet "I". Outlet 47 of the second passageway 43 is then closed by placing a finger into indentation 51 to tightly cover the outlet. Liquid is then poured into the bowl 13, of funnel 1 through its large inlet 5 and this liquid flows out of the bowl, through spout 15, into the container. As the liquid flows into the container, the air in the container, displaced by the liquid, flows out through the first passageway 27 which remains open. When the level of liquid in the container rises to the bottom end 11 of the spout to just cover it, the inlet 31 to passageway 27 is closed, an air-lock is formed in the container, and no more liquid enters the container from the funnel. Liquid is still poured into the bowl 13 however and the level of liquid starts to rise in the bowl. The bowl 13 can be sized to hold an amount of liquid substantially equal to the volume of the space in the container "C" between the end 11 of spout 15 and top wall "W". When the bowl 13 is nearly filled with liquid, pouring is stopped, and the outlet 47 of second passageway 43 is opened by removing the covering finger. Air can now flow out of the top of the container, breaking the air lock and allowing the liquid in the bowl to flow in and nearly fill the container. The empty funnel is then removed and the container closed.

Figure 4:
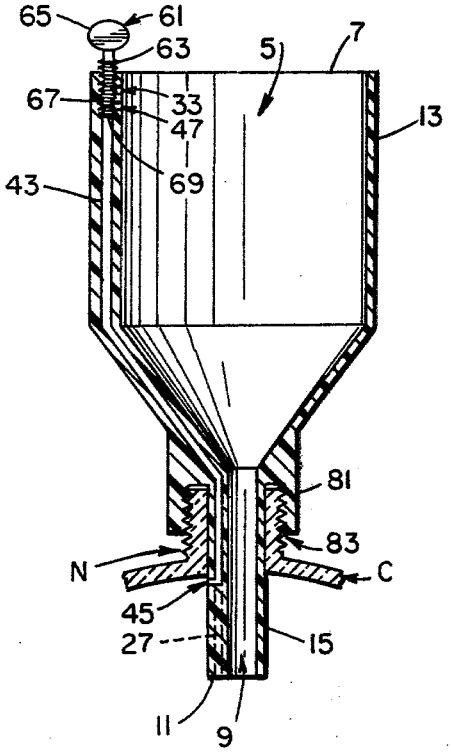
FIG. 4 is a cross-section view, similar to FIG. 2, showing another funnel embodiment with modifications to the vents and the connecting means.
Figure 5:
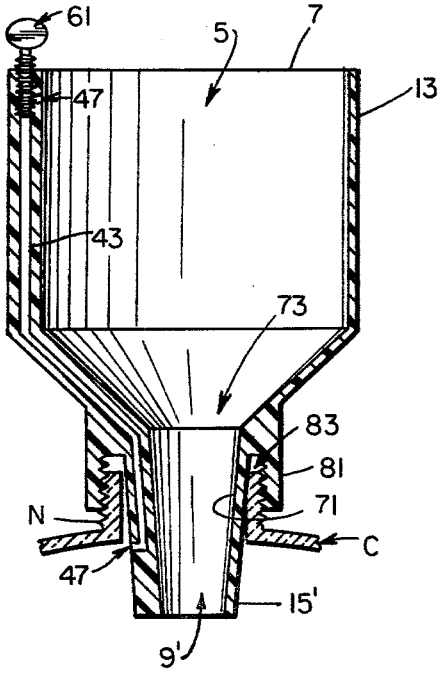
FIG. 5 is another cross-section view, similar to FIG. 2, showing a further funnel embodiment with modifications to the vents and the connecting means.

If desired, a simple, mechanical closure could be provided to close the second passageway 43 during initial filling of the container, and then to open it for final filling. Such a closure could comprise a valve 61 as shown in FIGS. 4 and 5, consisting of a threaded stem 63 and a handle 65 connected to the stem 63. The stem 63 is threaded into a tapped bore 67 which intercepts passageway 43. As shown in FIG. 4 the bore 67 can extend down from the top end 7 of bowl 13 and can be aligned with the passageway 43. Passageway 43 has its outlet 47 closesly adjacent outlet 33 of the first passageway 27. Stem 63 can be moved down bore 67, by turning handle 65, to have its front end 69 enter passageway 43 and thus close outlet 47. Outlet 47 is reopened by moving stem 63 out of passageway 43.

If the bowl 13 and spout 15 are quire large in size, the first passageway in the funnel wall could be eliminated. In this embodiment, as shown in FIG. 5 the spout 15' serves as the first passageway being large enough to pass liquid into the container as fast as liquid is poured into the bowl without completely closing up with liquid. Air is thus vented from the container through the bore 71 of spout 15', the bore 71 extending between the inlet 73 of spout 15', at the bottom of bowl 13, and the outlet 9' of the spount 15'. When liquid reaches the outlet 9' of spout 15', an air lock forms within the container since the second passageway is still closed. Liquid is still poured into the bowl to substantially fill it and the second passageway is then opened to complete filling of the container.

The length of the spout 15, 15' dictates the space remaining in the container to be filled with liquid after filling is stopped by the air lock. The bowl is sized to substantially equal this space in volume.

The substantially air-tight connection between the funnel and container can be provided by structure other than the wedging collar shown in FIG. 1. As shown in FIG. 4, a sleeve 81 could be provided about the funnel at the junction of the spout and the bowl, extending down from the bowl and concentric about the spout to provide a circular slot 83. The walls of the slot 83 can converge slightly toward the base 85 of the slot. The slot 83 is sized to snugly receive the neck "N" of the container "C". The upper end of the neck "N" frictionally engages the walls of the slot near its base to provide a substantially air-tight connection between the funnel and the container.

In another embodiment, as shown in FIG. 5, the inner surface of the sleeve 81' could be threaded and the funnel could be threaded onto the neck to provide the air tight connection.

I claim:

1. A funnel having: a large bowl with a large liquid inlet at one end; a spout projecting from the other end of the bowl with a small liquid outlet at its free end; means located on the spout end of the funnel for making a substantially air-tight connection with the inlet of a container to be filled; first and second separate vent means formed in the wall of said spout and said bowl by-passing the connecting means; said first vent means having a first opening in the outer surface of the wall of the spout and a second opening in the interior surface of said bowl; the second vent means having a first opening in the outer wall of said spout free to atmosphere and a second opening on the exterior wall of said bowl, the first opening of the first vent means being located nearer to the free end of the spout than the first opening of the second vent means and the second opening of the second vent means being arranged for manual control to selectively occlude the same.

2. A funnel as claimed in claim 1 wherein the connection means comprises a collar on the funnel, tapered toward the spout end of the funnel.

3. A funnel as claimed in claim 1 wherein the connection means comprises a sleeve connected to, and concentric about, the funnel; the sleeve forming, with the funnel, a slot opening toward the spout end to snugly, frictionally, receive the neck of a container to be filled.

4. A funnel as claimed in claim 1 wherein the connection means comprises a sleeve connected to, and concentric about, the funnel; the sleeve forming with the funnel, a slot opening toward the spout end, the outer wall of the sleeve defining the slot being threaded to threadably receive the neck of a container to be filled.

5. A funnel as claimed in claim 1 including valve means for opening or closing the second vent means.

6. A funnel as claimed in claim 1 wherein the first vent means has its first opening at the end of the spout and its second opening adjacent the one end of the bowl and the second vent means has its first opening adjacent the connecting means and its second opening near the one end of the bowl.

* * * * *